US009416488B2

(12) United States Patent
Stier et al.

(10) Patent No.: US 9,416,488 B2
(45) Date of Patent: Aug. 16, 2016

(54) TWISTING APPARATUS

(71) Applicant: SCHLEUNIGER HOLDING AG, Thun (CH)

(72) Inventors: Martin Stier, Werne (DE); Peter Schuetz, Solingen (DE)

(73) Assignee: SCHLEUNIGER HOLDING AG, Thun (CH)

( * ) Notice: Subject to any disclaimer, the term of this patent is extended or adjusted under 35 U.S.C. 154(b) by 285 days.

(21) Appl. No.: 14/357,264

(22) PCT Filed: Nov. 9, 2012

(86) PCT No.: PCT/IB2012/056309
§ 371 (c)(1),
(2) Date: May 11, 2014

(87) PCT Pub. No.: WO2013/068990
PCT Pub. Date: May 16, 2013

(65) Prior Publication Data

US 2015/0101700 A1 Apr. 16, 2015

(30) Foreign Application Priority Data

Nov. 11, 2011 (CH) ..... 1812/11

(51) Int. Cl.
*D07B 3/04* (2006.01)
*H01B 13/02* (2006.01)

(52) U.S. Cl.
CPC *D07B 3/04* (2013.01); *H01B 13/02* (2013.01); *H01B 13/0235* (2013.01); *H01B 13/0271* (2013.01); *H01B 13/0207* (2013.01)

(58) Field of Classification Search
CPC ..... D07B 3/04; H01B 13/02; H01B 13/0235; H01B 13/0271
See application file for complete search history.

(56) References Cited

U.S. PATENT DOCUMENTS 831,729 A 9/1906 Merry
1,178,566 A * 4/1916 Wright ..... D01H 1/305 242/128

(Continued)

FOREIGN PATENT DOCUMENTS

CH 673858 A5 4/1990
CN 201594421 U 9/2010

(Continued)

OTHER PUBLICATIONS

Full English Translation of International Search Report and written opinion, dated Mar. 6, 2013, from parent International appln. PCT/IB2012/056309 published as WO2013/068990A1 on May 16, 2013.

(Continued)

*Primary Examiner* — Shaun R Hurley
(74) *Attorney, Agent, or Firm* — George Kapsalas; Patentbuero Paul Rosenich AG

(57) ABSTRACT

The invention relates to a twisting apparatus (1) for twisting of electrical or optical lines (2) such as wires, cables, line bundles, optical fibers etc. in particular a cable twisting apparatus, comprising a base (5) and a twisting head (3) which can be rotated relative to the base (5), which is configured to grip the lines (2) to be twisted at their first ends, characterized in that the twisting apparatus (1) comprises a second twisting head (4) which can be rotated relative to the base (5), which is disposed opposite the first twisting head (3) and which is configured to grip the lines (2) to be twisted at their second ends opposite the first ends and that the second twisting head (3) can be rotated in the opposite direction to the second twisting head (4). The invention also relates to a method for twisting lines.

20 Claims, 3 Drawing Sheets

(56) References Cited

U.S. PATENT DOCUMENTS

| | | | | | |
|---|---|---|---|---|---|
| 1,333,147 | A * | 3/1920 | Wright | D01H 1/305 | 242/128 |
| 3,198,220 | A | 8/1965 | Scamberti | | |
| 3,540,110 | A | 11/1970 | Schwarz | | |
| 3,839,777 | A | 10/1974 | Puzio | | |
| 4,095,497 | A | 6/1978 | Radford et al. | | |
| 4,272,951 | A | 6/1981 | Vogelsberg | | |
| 4,506,566 | A | 3/1985 | Schmid | | |
| 4,655,107 | A | 4/1987 | Juergenhake | | |
| 4,699,414 | A | 10/1987 | Jones | | |
| 4,800,791 | A | 1/1989 | Jürgenhake | | |
| 5,033,785 | A | 7/1991 | Woolley, Jr. | | |
| 5,247,732 | A | 9/1993 | Lait et al. | | |
| 5,253,912 | A | 10/1993 | Andorlini et al. | | |
| 5,282,717 | A | 2/1994 | Löhr et al. | | |
| 5,350,101 | A | 9/1994 | Godlewski | | |
| 5,412,855 | A | 5/1995 | Koch | | |
| 5,650,181 | A | 7/1997 | Kotaki | | |
| 5,716,020 | A * | 2/1998 | Shults | A01K 97/28 | 242/443 |
| 5,816,384 | A | 10/1998 | Hsu | | |
| 5,820,008 | A | 10/1998 | College | | |
| 5,960,622 | A | 10/1999 | Koch et al. | | |
| 6,135,164 | A | 10/2000 | Celoudoux et al. | | |
| 6,167,919 | B1 | 1/2001 | Füchsl et al. | | |
| 6,289,944 | B1 | 9/2001 | Frommenwiler | | |
| 6,401,442 | B1 * | 6/2002 | Root | A01K 97/26 | 57/10 |
| 6,435,336 | B1 | 8/2002 | Knodler | | |
| 6,490,785 | B1 | 12/2002 | Kometani | | |
| 6,662,987 | B2 | 12/2003 | Erni | | |
| 6,702,099 | B2 | 3/2004 | Otaguro et al. | | |
| 6,735,933 | B2 * | 5/2004 | Abba | D01H 1/003 | 57/2.3 |
| 6,948,675 | B2 | 9/2005 | Frommenwiler | | |
| 6,999,847 | B2 | 2/2006 | Barry et al. | | |
| 7,021,510 | B2 | 4/2006 | Ellingson | | |
| 7,043,825 | B2 | 5/2006 | Conte | | |
| 7,178,708 | B2 | 2/2007 | Grinsted | | |
| 7,647,759 | B2 | 1/2010 | Braun et al. | | |
| 8,113,557 | B2 | 2/2012 | Kirst et al. | | |
| 8,234,850 | B1 * | 8/2012 | Wright | A44C 27/001 | 57/10 |
| 8,573,656 | B1 * | 11/2013 | Zhang | B65H 69/04 | 289/2 |
| 8,646,822 | B2 | 2/2014 | Braun et al. | | |
| 9,078,479 | B2 * | 7/2015 | Wright | A41F 9/002 | |
| 2005/0050713 | A1 | 3/2005 | Locher et al. | | |
| 2009/0241314 | A1 * | 10/2009 | Watanabe | H01B 13/0271 | 29/33 F |
| 2011/0049211 | A1 | 3/2011 | Schütz et al. | | |
| 2014/0352867 | A1 * | 12/2014 | McLane | H01B 13/227 | 156/50 |

FOREIGN PATENT DOCUMENTS

| | | | | |
|---|---|---|---|---|
| DE | 3630359 | A1 | 3/1988 | |
| DE | 4104597 | A1 | 10/1991 | |
| DE | 19624973 | A1 | 1/1998 | |
| DE | 19631770 | A1 | 2/1998 | |
| DE | 19844416 | A1 | 4/1999 | |
| DE | 10107670 | A1 | 9/2002 | |
| DE | 102010017981 | A1 | 10/2010 | |
| EP | 0303724 | A1 | 2/1989 | |
| EP | 0598276 | A1 | 5/1994 | |
| EP | 0708050 | A1 | 4/1996 | |
| EP | 0788200 | A2 | 8/1997 | |
| EP | 0984530 | A1 | 3/2000 | |
| EP | 1009074 | A2 | 6/2000 | |
| EP | 1032095 | A2 | 8/2000 | |
| EP | 1213800 | A1 | 6/2002 | |
| EP | 1387449 | A1 | 2/2004 | |
| EP | 0889486 | B1 | 8/2004 | |
| EP | 1447888 | A1 | 8/2004 | |
| EP | 1691457 | A1 | 8/2006 | |
| EP | 1032095 | A3 | 5/2008 | |
| GB | 868532 | A | 5/1961 | |
| JP | 2004-071237 | A | 3/2004 | |
| WO | 93/06320 | A1 | 4/1993 | |
| WO | 2009/141794 | A2 | 11/2009 | |
| WO | 2011/055336 | A1 | 5/2011 | |
| WO | WO 2012015057 | A2 * | 2/2012 | H01B 13/02 |
| WO | 2013/068981 | A1 | 5/2013 | |
| WO | 2013/068984 | A1 | 5/2013 | |
| WO | 2013/068986 | A1 | 5/2013 | |
| WO | 2013/068988 | A1 | 5/2013 | |
| WO | 2013/068998 | A1 | 5/2013 | |

OTHER PUBLICATIONS

International Search Report and written opinion, dated Mar. 6, 2013, from parent International appln. PCT/IB2012/056309 published as WO2013/068990A1 on May 16, 2013, with partial English transl.

Copending commonly-owned U.S. Appl. No. 14/273,020, filed May 8, 2014.

Copending commonly-owned U.S. Appl. No. 14/357,222 entered U.S. national phase May 11, 2014.

Copending commonly-owned U.S. Appl. No. 14/357,226 entered U.S. national phase May 11, 2014.

Copending commonly-owned U.S. Appl. No. 14/357,248 entered U.S. national phase May 11, 2014.

* cited by examiner

TWISTING APPARATUS

This application is a 35 U.S.C. 371 national-phase entry of PCT International application no. PCT/IB2012/056309 filed on Nov. 9, 2012 and also claims benefit of priority to prior Swiss national application no. CH-01812/11 filed on Nov. 11, 2011, and parent PCT International application no. PCT/IB2012/056309 is expressly incorporated herein by reference, in its entirety, for all intents and purposes, as if identically set forth in full herein.

The invention relates to a twisting apparatus and a method for twisting electrical or optical lines such as wires, cables, line bundles, optical fibres, etc., comprising a base and a first twisting head that can be rotated relative to the base, which twisting head is configured to grip the lines to be twisted at their first ends. Twisted lines are employed, for example, in vehicles, aircraft, etc., in order to reduce interference influences on, and from, other lines to the extent possible. The twisted lines must comply with specifications. They must have a defined uniform lay length over the entire length and the insulation must not be damaged. The average length of twisted lines in an automobile, for example, is about 4 meters.

Twisting machines are also known from the following documents U.S. Pat. No. 6,289,944B1, EP1032095A2, DE10107670A1, EP0889486B1 and DE19631770A1.

Lines that are initially clamped parallel to the line ends in holders are, according to the known prior art, set in rotation about the longitudinal axis by a driven twisting head at one line end, whereas the opposite line ends are clamped stationarily in the holder.

The disadvantage resulting from the known prior art can be seen in particular in that the actual twisting process hinders a temporal optimization of the process. The rotational speed of the twisting head is restricted with a view to process safety and protection of the lines.

It is the object of the invention to eliminate this disadvantage and provide a twisting process together with method by which the duration of the actual twisting process may be substantially reduced. At the same time, the line should be optimally protected. The twisting process should therefore take place in a line-protecting manner. The line insulation and the copper strands must not be damaged. A reliable and easy-to-program process sequence should be ensured.

This object is achieved with a twisting head of the type mentioned initially, whereby the twisting apparatus includes a second twisting head that can be rotated relative to the base and that is disposed opposite the first twisting head, and that is configured to grip the lines to be twisted at their second ends opposite the first ends. The second twisting head can be rotated in the opposite direction to the first twisting head.

By using oppositely rotating twisting heads at both line ends, the twisting time is approximately halved. In this case, the lines to be twisted are also treated in a gentle manner in the process as with twisting devices with one end-side twisting drive. The twisting heads are spaced apart from one another by approximately the length of the lines to be twisted. This spacing is preferably variable, in order to be adaptable to different cable lengths, and in order to exert a predetermined tensile force on the lines to be twisted during the twisting process. The twisting heads are, in this case, mounted on the base in such a manner that they substantially have this same axis as the axis of rotation. In the case of tensioned lines this axis approximately coincides with the longitudinal axes of the lines. The common base may be a frame, a table, a suspension, a socket, a mounting platform, a rail, and the like.

The lines are set in rotational movement about their longitudinal axis at both line ends by oppositely driven twisting heads and, in this way, twisted with one another in their entire twisting length. The line ends clamped in the twisting head are not twisted. The twisting heads preferably have their own drives.

The acceleration of the twisting head and therefore the lines about the longitudinal axis is initially accomplished slowly, so that the individual lines can form uniform loops with one another over the entire length, and so that they are stabilised in coherence. The twisting process is then further accelerated as far as the final rotational speed where the lines are held under tension with a defined tensile force in the longitudinal direction.

The twisting is accomplished according to adjustable programs. Initially, a preselectable number of revolutions is twisted in one direction, then specifically turned back in the opposite direction of rotation, so that the ready twisted line has no externally acting tension. This is the case when the twisted line that is no longer clamped lies stretched out flat on a surface without curving, does not turn about its own axis nor form loops.

Twisting devices according to the prior art have a twisting drive on only one line end and a non-rotating line holder at the second line end. For the same number of revolutions, the twisting process therefore lasts twice as long with one twisting head as with two oppositely driven twisting heads according to the present disclosure (requirement: the same acceleration ramps and maximum rotational speeds). The lines are treated equally gently. An approximate halving of the twisting time is therefore obtained for the same gentle twisting process, when compared to twisting devices with only one-sided twisting drive.

In a preferred version, one line transfer gripper is assigned to the twisting heads, which line transfer gripper transfers the respective ends of the lines to the respective twisting head. As a result, the lines to be twisted may be successively pulled into the region between the twisting heads. While one line that has already been pulled in is held by the line transfer gripper, a further line is pulled in which is then also received by the line transfer grippers. The lines to be twisted are then simultaneously transferred to the twisting heads. The successive pulling in of the lines has the advantage that the conveying means for pulling in the lines need not be designed to be double or multiple.

In a preferred version each twisting head is set in rotation by a separate rotary drive. As a result, each twisting head may be acted upon with its own acceleration ramp as required.

In a preferred version the rotary drives of the twisting heads are synchronised to one another. With the same rotational speeds with opposite direction of rotation, the twisting time may be reduced by the maximum, i.e. halved.

In a preferred version the twisting heads are displaceable for variation of their mutual spacing relative to one another. For the purpose of this displaceability the twisting heads have theft own displacement drives. As a result, the lines may be held continuously under tension during twisting, and on the other hand, the twisting heads may be adapted to different line lengths.

Preferably, at least one of the twisting heads sits on a displaceable carriage that is displaceable relative to the base. This constitutes a particularly simple and reliable possibility for varying the mutual spacing of the twisting heads in the longitudinal direction.

In a preferred version the twisting apparatus includes a line pull-in gripper for gripping the lines. In the region between the twisting heads, there runs a guide along which the line transfer gripper is displaceable in order to pull in the lines into the region between the twisting heads. This constitutes a simple, space-saving and reliable method for conveying the lines along their longitudinal extension in the twisting apparatus.

In a preferred version the base of the twisting apparatus comprises at least two parts, wherein a second part of the base is displaceable relative to a first part of the base along a direction that is substantially parallel to the direction of displacement of the line pull-in gripper along the guide. The guide with the line pull-in gripper sits on the first part of the base, and one of the twisting heads sits on the second part of the base. For positioning of the second part of the base relative to the first part of the base, the line pull-in gripper may be coupled to the second part of the base, preferably via an active interface (which otherwise brings the line pull-in gripper into an open and/or closed position) so that during a displacement along the guide, the coupled line pull-in gripper drives the second part of the base relative to the first part of the base and brings it into the desired position.

By this measure, the spacing between the twisting heads or between the line transfer grippers may be varied in a simple manner, for example, in order to adapt the twisting apparatus to the length of the lines to be processed. One of the twisting heads is thus displaced into its desired position in a programmable manner by the line pull-in gripper. A complete positioning axis can be saved as a result of this coupling function. The positioning is taken over by the line pull-in gripper whose control is already provided in any case.

An active interface is configured to come into operative communication with the line pull-in gripper and bring this into a dosed position, or open position, when the line pull-in gripper is located in the active region of the respective active interface. The line pull-in gripper is therefore preferably coupled via this same active interface to the displaceable part of the base, which same active interface is also used for opening (or closing, respectively) the line pull-in gripper.

For this purpose the active interface includes a gripper opener or closer for opening (or closing) the line pull-in gripper.

In a preferred version, the twisting heads each have at least two gripper arms that can be brought from an open position into a closed position gripping the lines. The use of gripper arms has proved to be particularly advantageous. Each twisting head therefore also has a gripper drive for opening and closing the gripper.

The aforesaid object is also achieved by a method for twisting of electrical or optical lines such as wires, cables, line bundles, optical fibres, etc., in a twisting apparatus including a base and a twisting head that can be rotated relative to the base, wherein the lines to be twisted are gripped at their first ends by the first twisting head. It is characterised in that the twisting apparatus includes a second twisting head that can be rotated relative to the base, which second twisting head is disposed opposite the first twisting head, wherein the lines to be twisted are gripped at their second ends opposite the first ends by this second twisting head, and the two twisting heads may be set in rotation in mutually opposite directions.

In a preferred version, the lines to be twisted are successively pulled into the twisting apparatus between the twisting heads. As a result of the successive pulling in, the conveying device need only be provided in one design, with the result that manufacturing costs can be reduced.

In a preferred version, the respective ends of the lines are transferred by line transfer grippers to the respective twisting head.

In a preferred version, the lines to be twisted are held by the line transfer grippers before they are simultaneously transferred to the twisting heads. This enables a particularly process-optimised procedure since the line transfer grippers perform two functions: (1) temporarily holding the line(s) until all the lines are pulled in, and, (2) transferring the lines to the twisting heads.

In a preferred version, the spacing of the twisting heads from one another is reduced during the twisting process, preferably as a function of: (a) the rotational speed or the revolutions of the twisting heads, and, (b) the resulting line entwinements of the twisted line pair. As a result, the total length of the line pair (or line bundle) reduced by the twisting may be compensated, and a predetermined tension may be maintained.

In a preferred version, the twisting heads are driven synchronised to one another.

In a preferred version, the rotational speed of the twisting heads is successively increased during a first section of the twisting process. As a result, a more gentle twisting process that takes account of the inertia of the lines is provided.

In a preferred version, the rotational speed of the twisting heads is successively reduced during a second section of the twisting process. This also provides a treatment that is gentle on the lines.

In a preferred version, the direction of rotation of the twisting heads at the end of the twisting process is reversed, in order to obtain a twisted line pair or line bundle free from mechanical stresses.

In a preferred version, the twisting apparatus includes a line pull-in gripper for gripping the lines; in the region between the twisting heads there runs a guide along which this line pull-in gripper is displaceable in order to pull in the lines into the region between the twisting heads. The base of the twisting apparatus includes at least two parts, wherein a second part of the base is displaceable relative to a first part of the base along a direction that is substantially parallel to the direction of displacement of the line pull-in gripper along the guide, and wherein the guide with the line pull-in gripper sits on the first part of the base, and one of the twisting heads sits on the second part of the base. For positioning of the second part of the base relative to the first part of the base the line pull-in gripper is coupled to the second part of the base, preferably via an active interface. The coupled line pull-in gripper is displaced along the guide so that the second part of the base is driven relative to the first part of the base by this line pull-in gripper and thus brought into the desired position. The line pull-in gripper is preferably coupled to the displaceable part of the base via the same active interface that is also used for opening the line pull-in gripper.

Advantageous further developments of the invention are presented in the figures.

Further advantages, features and details of the invention are obtained from the following description in which exemplary versions of the invention are described with reference to the drawings. In this case, the features mentioned in the disclosure may in each case be essential to the invention individually by themselves or in any combination.

The reference list is part of the disclosure. The figures are described cohesively and in an overlapping manner. The same reference numbers denote the same components, and any reference numbers with different indices specify functionally the same or similar components.

Figure 1:
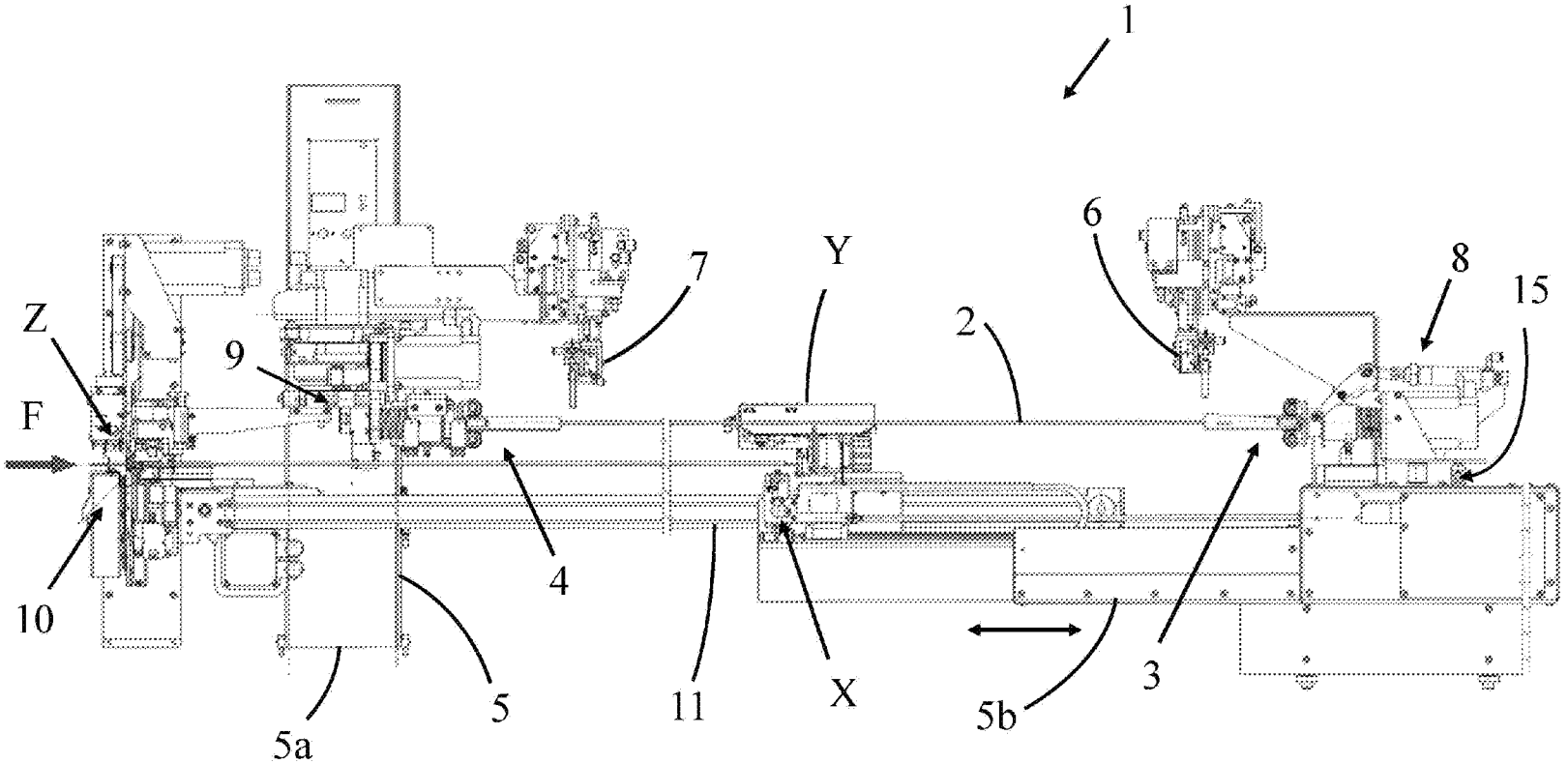
FIG. 1 depicts an embodiment of a twisting apparatus.

FIG. 1 shows a twisting apparatus 1 including a base 5 in the form of a base frame. A first twisting head 3 and a second twisting head 4 are disposed on this base 5 spaced apart from one another and opposite one another. The lines 2 to be twisted are clamped between the twisting heads 3, 4.

The base 5 preferably includes a first stationary part 5*a*, for example, a substructure mounted fixedly to the frame (in FIG. 1, left) and a second part 5*b* that is displaceable in the longitudinal direction, for example a wagon or carriage, by which the distance between the active interfaces may be varied, and that is positioned or fixed according to the line length to be twisted. The direction of travel is indicated by a double arrow in FIG. 1. The displaceable part 5*b* of the base 5 may be fixed on the stationary part of the base 5, i.e., can be locked in the desired position.

The lines 2 are pulled into the twisting apparatus 1 in direction F. This is accomplished by a line pull-in gripper 10 that is displaceable along a guide 11 in the form of a linear rail. During pulling in of the lines 2, the line pull-in gripper 10 moves from left to right. When the first end of a line 2 has arrived in the region of the first twisting head 3, a line transfer gripper 6 receives the first end of the line 2 and transfers it to the first twisting head 3. This grips the preferably successively pulled-in lines at their first end and holds them fixed during the twisting process.

The second end of the line 2 opposite the first end is gripped in a similar manner by a line transfer gripper 7 provided in the region of the second twisting head 4 and transferred to the second twisting head 4.

Each twisting head 3, 4 has its own rotary drive 8, 9 by which the respective twisting head is set in rotation.

Preferably, one of the twisting heads—in FIG. 1 this is the (right) twisting head 3—sits on a carriage 15 that is displaceable relative to the base 5 along the longitudinal direction (i.e. parallel to the axis of rotation of the twisting heads). In the exemplary version of FIG. 1, the carriage 15 is mounted on the displaceable second part 5*b* of the base 5, and is longitudinally displaceable relative to this. During the twisting process, the twisting head 3 can successively follow the shortening of the twisting line. This adaptation of the twisting head to the varying line length can be accomplished by an own displacement drive.

Figure 2:
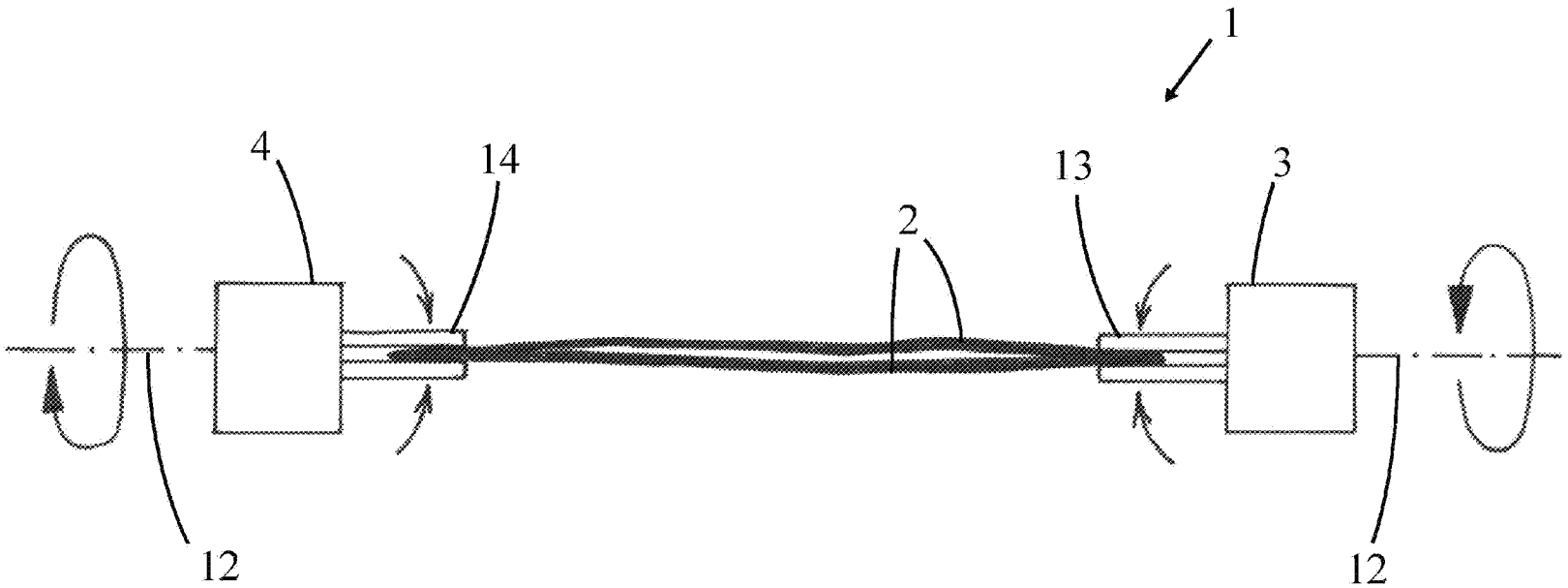
FIG. 2 depicts schematically a twisting apparatus in a view which emphasizes the function.

FIG. 2 shows in a schematic view which emphasises the function of the invention, a twisting apparatus 1 with the two twisting heads 3,4, in which twisting apparatus 1 two lines 2 are clamped. The twisting heads 3, 4 are mounted on the base in such a manner that they substantially rotate about the same axis of rotation 12.

In the embodiment shown, each twisting head 3,4 has two gripper arms 13, 14 that can be brought from an open position that receives the line ends into a dosed position that fixes the line ends. The closing movement of the gripper arms 13,14 is indicated by the arrows depicted in the region of the gripper arms 13,14.

When the first and second line ends are fixed in the opposite twisting heads 3,4, the twisting process begins. In this case, both twisting heads 3,4 are set in rotation in opposite directions. The opposite directions of rotation are indicated by the orientation arrows depicted in the left and right margin region of FIG. 2. The duration of the twisting process may be reduced by a half as a result of the contra-rotating twisting heads 3,4.

A possible function sequence in a twisting apparatus according to the invention is explained in detail in following.

The basic machine (called CrimpCenter at Schleuniger) initially conveys a line 2 into the twisting apparatus 1 by a line feed device (indicated by the arrow F shown on the left in FIG. 1). This line 2 has preferably already been fitted with a contact, for example by crimping, at its first right-hand end.

The line pull-in gripper 10 grips the leading first line end (in the region of the active interface Z, which brings the line pull-in gripper 10 with a gripper closer into the dosed gripping position) and conveys the line 2, synchronized with the line feed device (merely indicated by the arrow F) of the basic machine, to an active interface Y that includes a gripper opener for opening the line pull-in gripper 10. Here, the line transfer gripper X receives the first line end and the line pull-in gripper 10 travels back opened, in order to receive the next line 2.

The trailing second line end is now also fitted with a contact, for example by crimping, and is then transferred with the aid of additional handling mechanics to the second line transfer gripper 7. In the course of this transfer, the line transfer gripper X moves the leading line end of the first line from the active interface Y to the right to the line transfer gripper 6. The movements of the line transfers on the first and second side of the twisting apparatus 1 are matched to one another in such a manner that the respective line 2 remains taut with little sagging.

The line transfer grippers 6,7 preliminarily hold this first line 2 at its ends. In the meantime, in the line changer of the basic machine a changeover to the next line has taken place. This is now conveyed by the line feed device (arrow F) in the direction of the twisting apparatus 1. The leading line end is provided with a contact. This second line is now pulled into the twisting apparatus 1 by the line pull-in gripper 10 similarly to the first line (as described above) and is there also transferred to the line transfer grippers 6,7.

Two lines 2 are now already located in the line transfer grippers 6,7 for the transfer to the twisting heads 3,4.

After transfer of the two lines 2 into the clamping tongs of the twisting heads 3,4, the actual twisting process begins. Both twisting heads 3,4 are set in rotation in opposite directions in a programmed manner, are accelerated until the final rotational speed and the pre-programmed number of revolutions is reached. Then they are driven with a delaying ramp. At the end of the twisting process the directions of rotation of both twisting heads 3, 4 are reversed, i.e., they are each turned back in the opposite direction in a pre-programmed manner, so that the twisted line pair contains no outwardly acting stresses.

During the twisting process the lines 2 are exposed to a defined tensile force in the axial direction, so that the desired twisting result is achieved, and on the other hand, the lines 2 are not damaged. Then the gripper arms 13, 14 or clamping tongs of the twisting heads 3, 4 are opened and the twisted finished line pair drops into a depositing tray (not shown on account of clarity).

Figure 3:
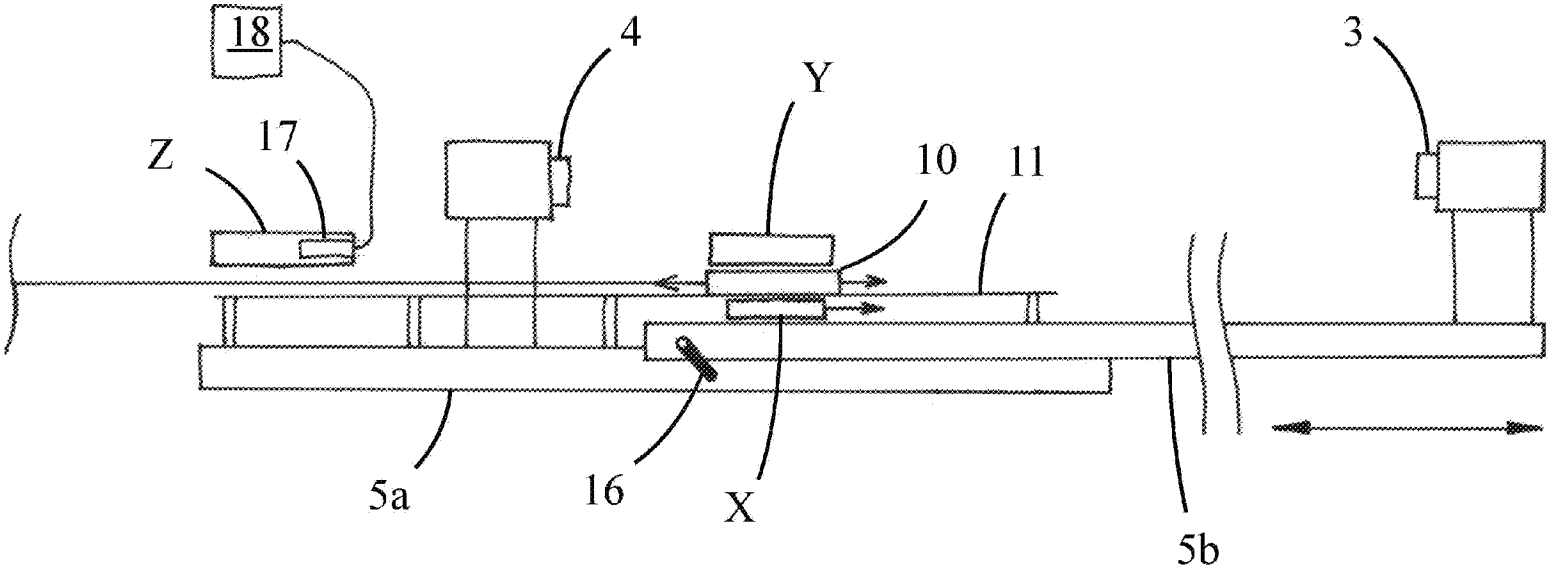
FIG. 3 depicts a version of a twisting apparatus.

FIG. 3 is a schematic view, simplified compared to FIG. 1, and depicts a version in which, again, the base 5 of the twisting apparatus 1 includes at least two parts 5*a*, 5*b*. A second part 5*b* of the base 5 is displaceable relative to a first part 5*a* of the base 5 along a direction that is substantially parallel to the direction of travel of the line pull-in gripper 10 along the guide 11. The guide 11 with the line pull-in gripper 10 sits on the first part 5*a* of the base 5, and one of the twisting heads 3 (the right-hand one in FIG. 3) sits on the second part 5*b* of the base 5.

In order to adapt the twisting apparatus to the line length at the beginning of the twisting process, for positioning the second part 5*b* of the base 5 relative to the first part 5*a* of the base 5, the line pull-in gripper 10 is coupled to the second part 5*b* of the base 5.

This is preferably accomplished via the active interface Y to which the line pull-in gripper 10 is brought, so that the active interface Y may fix the line pull-in gripper 10, for example by a gripping movement. The coupled line pull-in gripper 10 is now moved along the guide 11, and entrains the second part 5*b* of the base 5 with it. Thus, the second part 5*b* is now driven relative to the first part 5*a* of the base 5, and brought into the desired position. The line pull-in gripper 10 is then uncoupled again. A brake 16 is provided to lock the second part of the base in the desired position.

In other words: for setting up the machine to the desired line length, the displaceable part 5*b* must be repositioned. To this end, the line pull-in gripper 10 initially travels, without the line, to the active interface Y. The coupling takes place in this position. The brake 16 of the displaceable part 5*b* is then released. The (indirect) coupling of the line pull-in gripper 10 to the second part 5*b* now enables this second part 5*b* to be displaced into the new position with the aid of the linear axis of the line pull-in gripper 10. At the new position, the brake 16 of the second part 5*b* is again fixed, and the line pull-in gripper 10 uncoupled. The twisting apparatus 1 with the line pull-in gripper 10 is now ready to draw in new lines to be twisted.

In the example of FIG. 3 the second part 5*b* of the base is mounted directly on the first part 5*a* of the base. Alternatively, the second part 5*b* of the base could also be mounted on the guide 11, and may be displaced along the guide 11 and locked. The expressions 'first and second part of the base' should therefore be understood in the broadest sense.

As can be seen from FIG. 3, at least one active interface Z preferably includes a piston unit 17, preferably a pneumatic cylinder, in order to bring the line pull-in gripper 10 into a dosed position for open position), where the supply pressure for the cylinder-piston unit 17 is variably adjustable by a controller 18.

The disclosure of the following commonly owned applications: published PCT application no. WO 2013/068981A1 published May 16, 2013; published PCT application no. WO 2013/068984A1 published May 16, 2013 and nationalized in the U.S. as U.S. application Ser. No. 14/357,222; published PCT application no. WO 2013/068986A1 published May 16, 2013 and nationalized in the U.S. as U.S. application Ser. No. 14/357,226; and, published PCT application no. WO 2013/068988A1 published May 16, 2013 and nationalized in the U.S. as U.S. application Ser. No. 14/357,248; (Internal file references of the Common Applicant respectively being: S124PWO, S125PWO, S126PWO, S127PWO, which were all filed at the International Bureau on Nov. 9, 2012, form an integral component of the present application and should be seen in combination with the same, since these separate applications each relate to different aspects of the same machine. Further synergistic effects result from this.

LIST OF REFERENCE LABELS

1 Twisting apparatus
2 Lines
3 First twisting head
4 Second twisting head
5 Base
5*a* First part of base 5
5*b* Second part of base 5
6 First line transfer gripper
7 Second line transfer gripper
8 Rotary drive for first twisting head 3
9 Rotary drive for second twisting head 4
10 Line pull-in gripper
11 Guide for line pull-in gripper 10
12 Axis of rotation of twisting heads
13 Gripper arms of first twisting head 3
14 Gripper arms of second twisting head 4
15 Carriage
16 Brake
X Line transfer gripper
Y Active interface with gripper opener
Z Active interface with gripper closer

What is claimed is:

1. A line twisting machine comprising:
a base;
a first rotatable twisting head operatively supported by said base, said first rotatable twisting head rotating relative to said base in a first direction of rotation, said first rotatable twisting head having at least one respective rotating gripper for lines;
a first drive operatively connected to drive said first rotatable twisting head in said first direction of rotation;
a second counter-rotatable twisting head operatively supported by said base, said second twisting head rotating relative to said base in a second direction of rotation that is opposite to that of said first direction of rotation, said second twisting head having at least one respective rotating gripper for lines;
a second drive operatively connected to drive said second twisting head in said second direction of rotation opposite to that of said first direction of rotation;
a guide, said guide being located in a region between said first and second twisting heads;
a line pull-in gripper, said line pull-in gripper being operatively mounted for controlled displacement in a first path along said guide to pull lines in the region between said first and second twisting heads;
an intermediate line transfer gripper, said intermediate line transfer gripper receiving lines from said line pull-in gripper; and,
a first line transfer gripper situated to transferring lines from said intermediate line transfer gripper to said respective gripper of said first rotatable twisting head.

2. A line twisting machine as claimed in claim 1, further comprising:
a second line transfer gripper situated to transfer lines to said respective gripper of said second twisting head.

3. A line twisting machine as claimed in claim 1, further comprising:
said base having a first part;
said base having a second part, said second part being controllably displaceable relative to said first part along a second path substantially parallel to said first path;
said guide and said line pull-in gripper being situated on said first part of said base;
an active interface on said second part, said active interface cooperating with said line pull-in gripper to controllably position said second part relative to said first part; and,
said first twisting head being operatively mounted on said second part.

4. A line twisting machine comprising:
a base;
a first rotatable twisting head operatively supported by said base, said first rotatable twisting head rotating relative to said base in a first direction of rotation, said first rotatable twisting head having at least one respective rotating gripper for lines;
a first drive operatively connected to drive said first rotatable twisting head in said first direction of rotation;
a second counter-rotatable twisting head operatively supported by said base, said second twisting head rotating relative to said base in a second direction of rotation that is opposite to that of said first direction of rotation, said second twisting head having at least one respective rotating gripper for lines; and, a second drive operatively connected to drive said second twisting head in said second direction of rotation opposite to that of said first direction of rotation.

5. A line twisting machine as claimed in claim 4, further comprising;

a line transfer gripper situated to transfer lines to said first rotatable twisting head.

6. A line twisting machine as claimed in claim 5, further comprising:

a second line transfer gripper situated to transfer lines to said second twisting head.

7. The line twisting machine as claimed in claim 4, wherein:

said first drive is operatively synchronized with said second drive.

8. A line twisting machine as claimed in claim 4, further comprising:

a carriage mounted to be displaceable relative to said base, said carriage having one of said first twisting head or said second twisting head mounted thereon to selectively vary the mutual spacing between said first and second twisting heads.

9. A line twisting machine as claimed in claim 4, further comprising:

a guide, said guide being located in a region between said first and second twisting heads; and, a line pull-in gripper, said line pull-in gripper being operatively mounted for controlled displacement in a first path along said guide to pull lines in the region between said first and second twisting heads.

10. A line twisting machine as claimed in claim 9, further comprising;

said base having a first part;

said base having a second part, said second part being controllably displaceable relative to said first part along a second path substantially parallel to said first path;

said guide and said line pull-in gripper being situated on said first part of said base;

an active interface on said second part, said active interface cooperating with said line pull-in gripper to controllably position said second part relative to said first part; and, said first twisting head being operatively mounted on said second part.

11. A line twisting machine as claimed in claim 4, further comprising:

at least two respective gripper arms in said respective rotating line gripper of said first twisting head; and, at least two respective gripper arms in said respective rotating line gripper of said second twisting head.

12. A method of twisting electrical or optical lines comprising the steps of:

gripping lines to be twisted by a first rotating twisting head;

gripping the lines to be twisted by a second, counter-rotating twisting head; and, controllably driving the first twisting head to rotate in a first direction of rotation relative to a base while simultaneously controllably driving the second twisting head to rotate in a second direction of rotation that is opposite to the first direction of rotation.

13. A method of twisting electrical or optical lines as claimed in claim 12, further comprising the step of:

sequentially pulling lines to be twisted into the region between the first twisting head and the second twisting head.

14. A method of twisting electrical or optical lines as claimed in claim 12, further comprising the step of:

transferring respective line ends to the respective first and second twisting heads by line transfer grippers.

15. A method of twisting electrical or optical lines as claimed in claim 12, further comprising the step of:

reducing the mutual spacing of the first and second twisting heads from one another during the step of controllably driving the first and second twisting heads.

16. A method of twisting electrical or optical lines as claimed in claim 12, further comprising the step of:

reducing, as a function of the revolutions of the twisting heads, the mutual spacing of the first and second twisting heads from one another during the step of controllably driving the first and second twisting heads.

17. A method of twisting electrical or optical lines as claimed in claim 12, further comprising the step of:

driving the first and second twisting heads in a synchronized manner.

18. A method of twisting electrical or optical lines as claimed in claim 12, further comprising the step of:

successively reducing the rotational speed of the first and second twisting heads during a second phase of twisting.

19. A method of twisting electrical or optical lines as claimed in claim 12, further comprising the step of:

mutually reversing the directions of rotation of the first and second twisting heads after an end phase of twisting.

20. A method of twisting electrical or optical lines as claimed in claim 12, further comprising the steps of:

operating a line pull-in gripper in the region between the first twisting head and the second twisting head; and, controllably positioning one part of a machine base relative to another part of the machine base by controllably coupling the line pull-in gripper to an active interface situated on the one part so as to drive the one part relative to the other part.

* * * * *